US005351951A

United States Patent [19]

Hodgetts

[11] Patent Number: 5,351,951

[45] Date of Patent: Oct. 4, 1994

[54] IDENTIFICATION AND USE OF GOLF CLUB SELECTIVITY

[76] Inventor: George W. Hodgetts, 971 Orange Ave., West Haven, Conn. 06516

[21] Appl. No.: 979,070

[22] Filed: Nov. 17, 1992

Related U.S. Application Data

[63] Continuation-in-part of Ser. No. 694,648, May 2, 1991, Pat. No. 5,163,681.

[51] Int. Cl.[5] ..... A63B 53/00

[52] U.S. Cl. ..... 273/77 A

[58] Field of Search ..... 273/77 R, 77 A, 77 B, 273/81 R, 81.4, 187.5

[56] References Cited

U.S. PATENT DOCUMENTS

| | | | |
|---|---|---|---|
| 3,344,729 | 5/1969 | Shobert | 273/77 R X |
| 3,395,571 | 8/1969 | Murdoch | 273/77 A |
| 3,638,295 | 2/1972 | Sparks | 273/81 R X |
| 4,070,022 | 1/1978 | Braly | 273/77 A |
| 4,122,593 | 10/1978 | Braly | 273/77 A X |
| 4,128,242 | 12/1978 | Elkins | 273/77 A |
| 4,415,156 | 11/1983 | Jorgensen | 273/77 A |
| 4,555,112 | 11/1985 | Masghati | 273/77 X |
| 4,900,025 | 2/1990 | Suganuma | 273/77 R X |
| 5,040,279 | 8/1991 | Braly | 273/77 A X |
| 5,094,101 | 3/1992 | Chastonay | 273/77 A X |
| 5,163,681 | 11/1992 | Hodgetts | 273/77 A |

*Primary Examiner*—William H. Grieb
*Attorney, Agent, or Firm*—Bruce F. Jacobs

[57] ABSTRACT

The selectivity or the damping factor or the bandwith of a golf club can be determined by stimulating a club and measuring the rate of decay of the displacement, velocity, or acceleration. The resulting information provides a measure of the risk of off-speed swings from using a particular golf club and enables a better fit to be accomplished between a golf club and a player.

8 Claims, 8 Drawing Sheets

IDENTIFICATION AND USE OF GOLF CLUB SELECTIVITY

CROSS-REFERENCE TO RELATED APPLICATION

This application is a continuation-in-part of U.S. application Ser. No. 694,648, filed May 2, 1991, now U.S. Pat. No. 5,163,681.

BACKGROUND OF THE INVENTION

Many golfers have one or two favorite clubs, which they refer over the rest of the clubs in their set. The favorite club(s) usually feels and performs better for the golfer. If the golfer could duplicate the performance of this favorite club and make each of the clubs in his set feel and perform like his favorite club, the golfer could improve his game.

That a golfer finds a difference in behavior of one club from another in a set is not surprising due predominantly to normal shaft manufacturing tolerances. Shafts made from the same die can vary substantially. For example, steel shafts of a leading manufacturer are permitted to vary by up to ±2.5% in stiffness and still be within tolerance. With the difference between "regular" and "stiff" shafts or "stiff" and "extra stiff" being only about 2.5%, a shaft within a set can vary all the way from "regular" to "extra stiff" even though all the shafts in the set were made from a "stiff" die.

Attempts at duplication of a golf club to copy a single golf club or to produce a matched set of clubs are well known in the art. A variety of different methods have been proposed to accomplish these difficult tasks. One of the most popular techniques involves the determination of and then matching the natural frequency of the clubs or, in some instances, the club shafts. U.S. Pat. Nos. 3,395,571; 4,070,022; 4,122,593; 4,555,112; and 4,736,093 and U.K. Application No. 2,223,951 each disclose methods of duplicating golf clubs and/or producing matched golf club sets by means of club or shaft natural frequency matching.

U.S. Pat. No. 3,698,239 discloses a method of producing a dynamically matched set of clubs by starting with a favorite club, determining its moment of inertia of mass for a selected swinging axis by calculation from its length and weight, and producing the remaining set to have the same moment of inertia, by calculation. The use of the moment of inertia in the duplication of golf clubs is also disclosed in U.S. Pat. No. 4,128,242.

U.S. Pat. No. 4,175,440 discloses dynamic testing and matching of clubs by measuring the angular velocity and centrifugal force along the axis of the club shaft as the club is swung on an arcuate path using an adjustable power rotational drive means.

Overall mass matching is used in U.S. Pat. No. 4,415,156 to produce a matched set of clubs.

In U.S. Pat. No. 4,900,025 a correlated set of clubs is made by matching the shaft flexure characteristics such that the deflection of a reference point is substantially uniform when a given torque is applied at the point.

None of these techniques, however, have developed enough or in some cases the right information about a particular club to enable one to accurately and completely duplicate the club so that the duplicate club performs and feels like the club being duplicated.

Also, none of these techniques have developed enough or in some cases the right information about a particular club to enable one to accurately and completely match other clubs in a set so that matched club(s) perform and feel like the first club.

Particularly, the prior art has not recognized that club or shaft selectivity (or damping factor or bandwidth) are important to the proper selection of a club for a particular player. The art has not related a golf club's ability to perform to its capacity to forgive off-speed swings.

Moreover, the art has not adequately addressed the issue of how to select a "pattern" club so as to produce a set of clubs appropriate for a particular individual. It has been left up to a player or his teacher or clubfitter to attempt to select an initial club for replication throughout a set of golf clubs.

Accordingly, it is an object of the present invention to develop a method and device to either duplicate a golf club or to produce a matched set of clubs so that the golfer using the produced clubs can not tell the difference between the clubs.

It is a further object to differentiate golf clubs based upon their selectivity for forgiving off-speed swings.

It is a still further object to scientifically determine which golf club of a series has the appropriate selectivity for a particular golfer.

It is another object of this invention to alter a golf club's selectivity by selection of shaft material and shaft construction methods and to alter Q of existing clubs by changing clubhead weight and grip hardness.

It is an object of this invention to measure a golfer's swing speeds with a multiplicity of test clubs and to perform statistical calculations and a device for measuring, storing, calculating and displaying swing speed characteristics such as mean speed for swings taken with each test club and the statistical variation, sigma, of a normal distribution of the same swings. The optimum test club frequency is revealed by these statistics: the best club is associated with the highest average swing speed of each sample and the lowest sigma.

SUMMARY OF THE INVENTION

The present invention is directed to a method of duplicating a single golf club, a method of producing a matched set of golf clubs, and a device for carrying out the duplication or matching process. As used herein, the term "duplicating" means producing a golf club which feels and performs substantially the same as the golf club being duplicated when used in the same manner.

The duplicating or matching process generally comprises attaching a golf club to be duplicated or matched to an oscillating means at the club's grip end, oscillating the golf club over a range of frequencies, measuring at each frequency the excursion of the golf club head from a stationary position, and thereafter plotting the excursion versus the frequency of the club head to form a curve which is defined herein as a "spectral response curve." The curve formed by such plotting normally has a distinctive peak that appears at about the natural frequency of the golf club. The natural frequency is the frequency at which the maximum excursion occurs. Once a spectral response curve for the golf club to be duplicated or matched has been measured and plotted, a golf club shaft having substantially the same spectral response curve, at least at about the portions of the curve near the natural frequency of the club, is selected.

Preferably a multiplicity of golf club shafts are pretested to determine their spectral response curves by oscillating each shaft with dummy club heads attached thereto. Thus, when it is time to select an appropriate shaft, all that needs to be done is to select a shaft having a spectral response curve that is substantially the same as the spectral response curve of the club to be duplicated at least at about the portion of the curve corresponding to the natural frequency of the club. This comparison process may be carried out in any suitable manner including manually by using transparent overlays and electronically by using an appropriate computer program.

After an appropriate shaft of the same length is located, a club head of the same weight, size, loft, and lie as the head on the club being duplicated is attached to the new shaft.

Other properties and dimensions of the golf club which con-tribute to producing a duplicate of a golf club or a matched set of clubs include: the club swing weight and the overall weight of the club, the torque of the shaft, the flex point of the shaft, and the grip diameter of the grip end of the club. In duplicating a golf club or matching a set of golf clubs these properties and dimensions may also be duplicated or matched to produce the new club.

The present invention is further directed to a method of measuring a golf club's selectivity, Q, a device for so doing, a method for quantifying Q, and a golf club having its selectivity indicated thereon. To determine Q for a golf club, a club clamped by its grip in a stationary vise is induced to oscillate by pulling the club head back several inches from its normal resting position and releasing it. Q is calculated by measuring the rate of decay of the displacement, velocity, or acceleration of the club head and then utilizing well known second order differential equations that describe damped harmonic motion.

BRIEF DESCRIPTION OF THE DRAWINGS

FIG. 1(*b*) is a side view of the golf club of FIG. 1(*a*).

DETAILED DESCRIPTION OF THE INVENTION

Figure 1A:
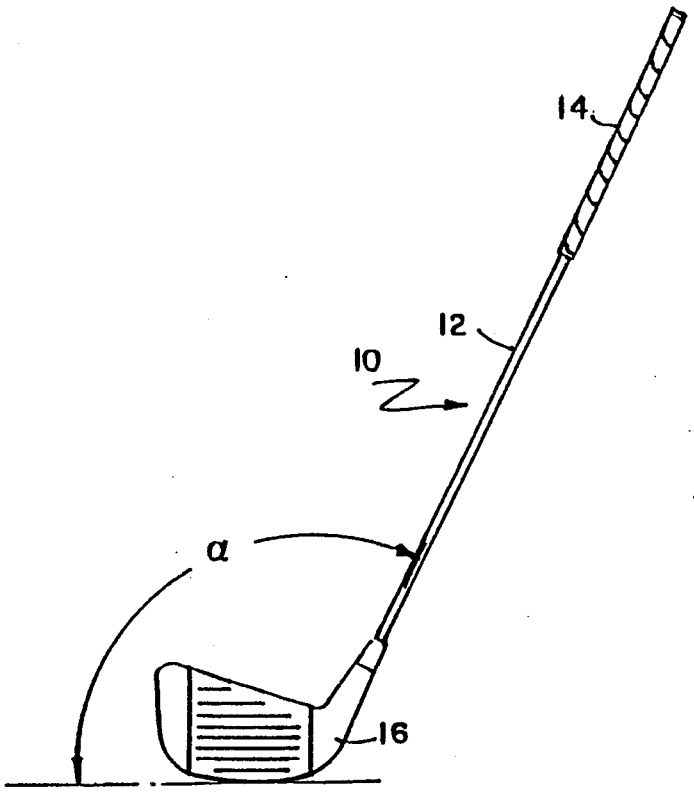
FIG. 1(*a*) is a plan view of a golf club.

As shown in the drawings, a golf club 10 comprises a shaft 12 having at one end a grip portion 14 and at the other end a club head 16. As is well known in the art, the club head may be either a "wood" head or an "iron" head. The term wood head refers to a particular type of club well known in the art used to drive golf balls longer distances than irons. It may be manufactured from a variety of conventional materials including metal, wood, graphite, and polycarbonate. Iron heads are generally made of materials such as cast or malleable iron or plastic composites and are generally used to drive golf balls shorter distances in comparison to the woods. The shaft may be made of any of a variety of conventional materials including steel, aluminum, graphite, or fiber-filled polycarbonate. A set of golf clubs generally comprises iron wedges such as the sand and pitching wedges, short irons (7–9 irons), long irons (2–6 irons), short woods (3–5 woods), and long woods (1–2 woods), though more or less clubs may be in an actual set.

According to the present invention, any golf club, whether it be a wood or an iron and notwithstanding the construction of the shaft or the materials used to form the shaft or head, may have its performance duplicated by the method herein.

Figure 2:
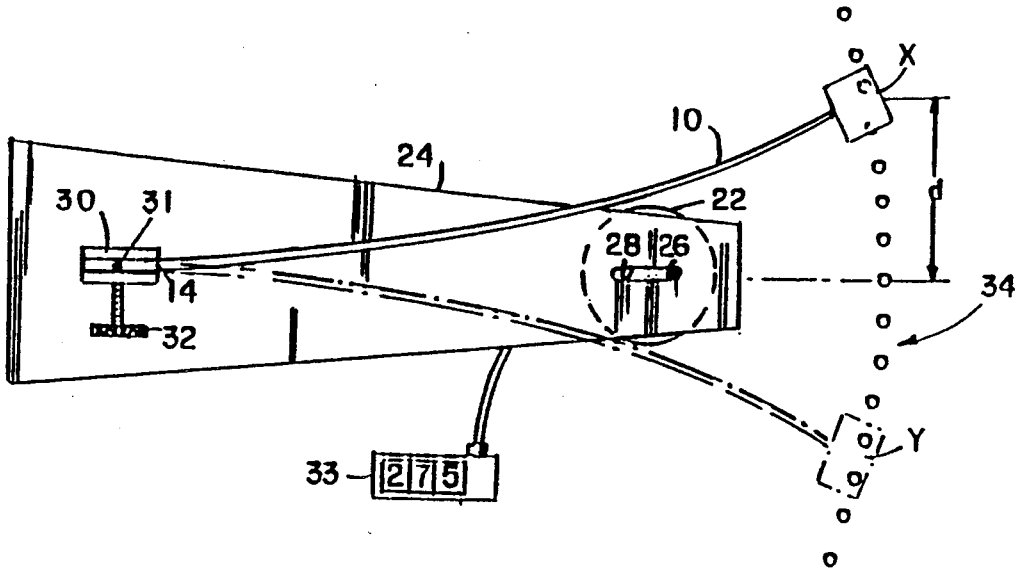
FIG. 2 is a top view showing the operation of an oscillating means according to the present invention.
Figure 3:
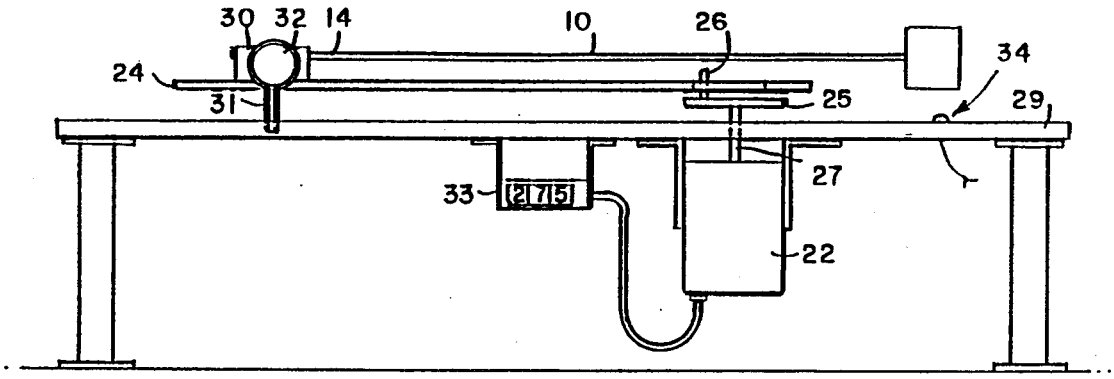
FIG. 3 is a side view of the oscillating means of FIG. 2.

The method according to the present invention comprises attaching the golf club to be duplicated or matched at its grip end to an oscillating means such as an oscillating motor and oscillating the club over a range of frequencies. Other oscillating means which may be employed include a linear motor attached to the grip end of the club, a servo motor programmed to oscillate back and forth, and a magnetically induced oscillating motor. While the specific frequency range used for the oscillations will depend upon the particular club and materials used to make the club, the range of frequencies used is generally from about 200 RPM to 800 RPM, preferably from about 225 RPM to 375 RPM. At each frequency, the excursion of the club head from its stationary position is measured. The excursion may be measured by any suitable means including a visual scale such as a ruler or the like or an optical sensor array. It is presently preferred to measure the excursion by a sensor array so that the phase angle, a parameter discussed hereinafter, may also be measured. If a visual scale such as a ruler is used, the phase angle measurement is not possible. According to an embodiment of the present invention and best shown in FIG. 2 to 3, a rotating motor 22 connected to an oscillating arm 24 by means of a pin 26 mounted on the outer edge of a disk 25 which is attached to the motor shaft 27. The pin 26 fits into a slot 28 in the oscillating arm 24. It is presently preferred to employ a rotating synchronous AC motor driven by a variable frequency controller which can hold a set point of speed at $\pm 1$ RPM. By this arrangement, the rotational movement of the motor is translated into oscillating movement in the oscillation arm 24, which is attached to surface 29 by means of a pin 31 so as to form a pivot at the grip end of the club. Attached to the oscillating arm 24 is a vise 30 used to hold the golf club 10 at its grip end 14. A screw 32 is used to tighten and loosen the vise. A tachometer 33 which is electrically connected to the motor is used to measure the speed of the motor. In this embodiment, an optical sensor array 34 arranged in a semi-circular path is used to measure the excursion of the club head. As shown, a set of light emitting diodes (LED's) are arranged in a semi-circle under the path that the clubhead subscribes with a sinusoidal generator (not shown) whose output magnitude is proportional to the highest order LED covered by the clubhead as it swings at each frequency. As an alternative to the optical sensor array, a strain gauge placed on the shaft of the club near the clubhead with an analog output could be employed. The analog output is a continuous voltage which is roughly proportional to the displacement of the clubhead. Still another measuring technique which could be employed is to use a strain gauge to measure the phase angle (hereinafter discussed) and an optical sensor with a short term memory to scan the LED's to sense the highest order LED intercepted by the clubhead. As shown, when the oscillating means is operating, the club head oscillates from one position shown at X to another position shown at Y. These X and Y points will change as the frequency of the motor is varied. The excursion of the club head is shown in FIG. 2 as the distance "d" which will also change as the frequency changes.

Figure 4:
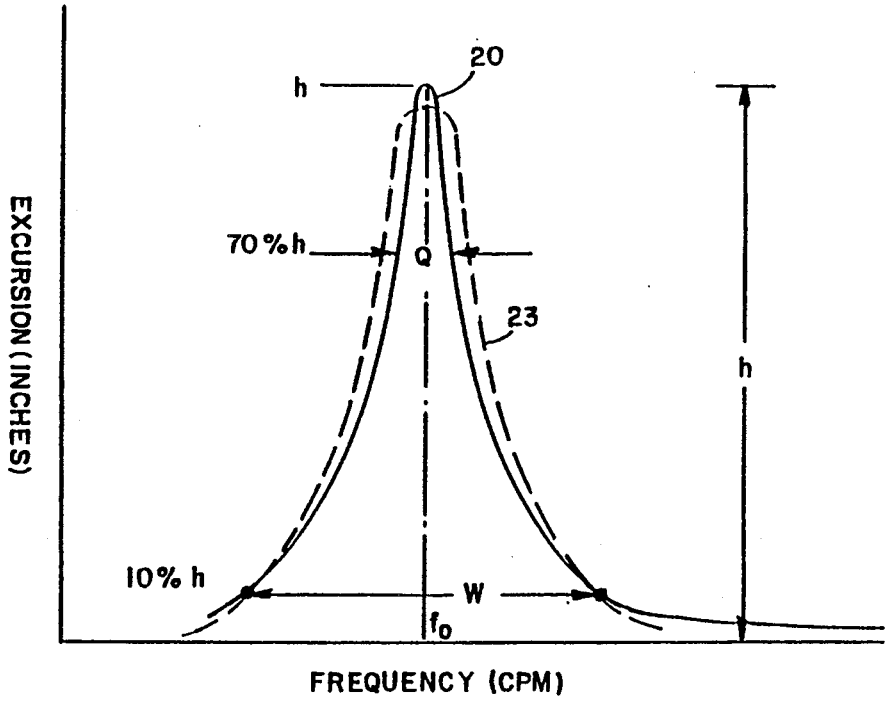
FIG. 4 is a graph showing matching spectral response curves according to the present invention.

The frequency and excursion measurements are then used to plot a curve, defined herein as a "spectral response curve." FIG. 4 shows such a curve 20 for a golf club. As shown, the spectral response curve has a distinctive peak. The peak is at the natural frequency ($f_o$) of the club. The shape of the curve at about the natural frequency of the club (the portion generally extending from the beginning of the upward slope and the ending of the downward slope shown as W in FIG. 4) provides important information about the performance of the club. Both the height of the peak at $f_o$ and the width of the peak at various percentages of the heights of the curve at $f_o$ are useful parameters in the process of duplicating or matching a golf club.

As shown in FIG. 4, the width of the spectral response measured at about 70% of the height "h" of the peak at $f_o$, shown as Q, represents the ability of the club to forgive offspeed swings. It also is a measure of mechanical gain which is in conflict with forgiveness; i.e. narrow peaked shafts result in high mechanical gain and non-forgiving clubs. Only players with very repetitive swings or those who hope to achieve distance at the expense of accuracy should play with narrow peaked shafts. When determining the characteristics of a club to produce a matched set of clubs therefrom, the width of the peak Q is important to consider. Width measurement of the curve at other points such as about 10% and 70% of the height of the peak at $f_o$ may also be used in matching the spectral response curve of the club to be duplicated or matched.

Once the spectral response curve for the golf club whose performance is to be duplicated is determined, the next step in the process is the selection of a club shaft which, when a club head substantially equal in weight to the club head being duplicated is attached thereto, has substantially the same spectral response curve as the golf club that is being duplicated or matched, at least at about the portions of the curve corresponding to the natural frequency of the golf club. As used herein, "substantially the same spectral response curve" means that the amplitudes of the two curves at the portions of the curves at about the $f_o$ peaks are within about ±10%, more preferably within about ±6%, and most preferably within about +3%, and at other frequencies of the curves being matched within about ±15%, more preferably within about ±10% and most preferably within about +7%. Preferably, the natural frequencies $f_o$, at which the peaks occur, are within +1%, preferably ±0.5%, and most preferably ±0.1% The spectral response curve for a suitable new club is shown, by means of example only, in FIG. 4 as a dotted line 23.

To obtain a more precise duplication, the spectral response curves of the club being duplicated can be matched with the new club over the same and entire frequency range measured.

Since the spectral response curves for various golf clubs may vary significantly from one golf club to another due to shaft design and shaft manufacturing tolerances, it is presently preferred to measure the spectral response curves for a large variety of shafts with various golf club heads or dummy heads simulating a golf club head attached thereto. Such spectral response curves can then be placed on file and matched to the spectral response curve of a golf shaft to be used to construct a golf club which a customer desires to duplicate or to which other clubs in a set are to be matched. The matching of the spectral response curves may be accomplished by any suitable means including using transparent overlays to match up the curves or using conventional electronic means such as a computer with appropriate programming to match the curves.

To make the duplication process more precise, two other parameters not directly associated with the spectral response curve may be measured and matched. Those two parameters are the flex point and the torque of the club shaft. The flex point is determined by oscillating the club as described above at a frequency of $2f_o$ and observing and identifying the point on the club shaft which is substantially stationary while the remainder of the club oscillates. This point is approximately two thirds of the distance from the grip end of the club to the club head. Two clubs having shafts of identical longitudinal stiffness but differing flex points may present a detectable "feel" variation to the golfer. Thus the flex points should be matched to more precisely duplicate the golf club. When the flex point of two clubs is being matched it should be at the same distance from the grip end of the club ± about 0.5 inches, more preferably ± about 0.25 inches, and most preferably ± about 0.1 inches.

Figure 5:
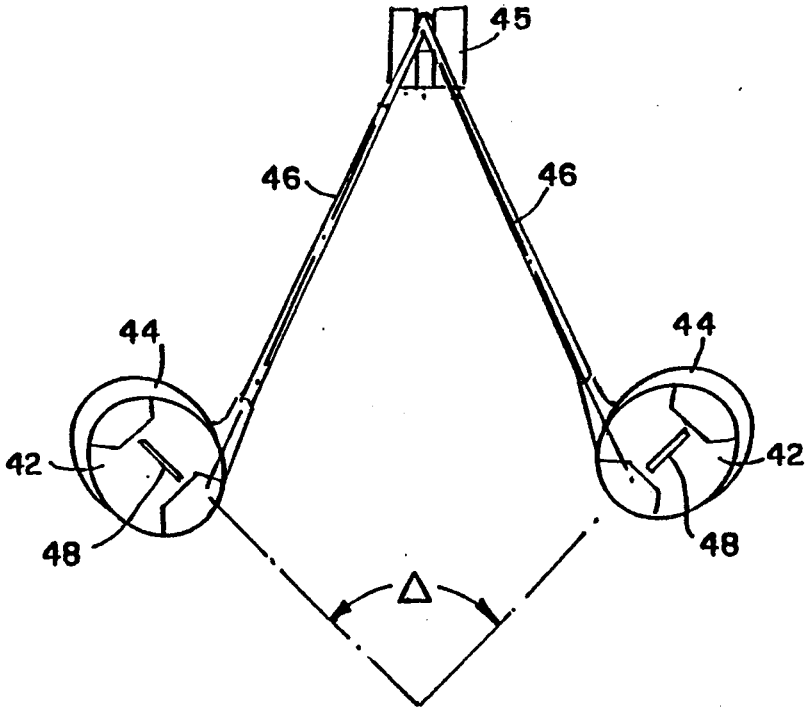
FIG. 5 is a front view of FIG. 2 showing the measurement of the torque.

The torque of the club is generally defined as the resistance to twisting of the club shaft. As shown in FIG. 5, it is measured by marking the sole plate 42 on club head 44 of the club 46 being duplicated with chalk or other suitable mark 48 and using a synchronized strobe light (not shown) to read the angle of deflection (D) when the club is oscillated at its natural frequency ($f_o$) using a suitable oscillating means 45 such as the device shown in FIG. 2. This deflection is caused by the center of gravity of the club head being located off the center of the shaft. The torque of the duplicate or matched club should generally be about equal to or stiffer than the club being duplicated, which translates into an angle D for the duplicate club of about equal to or less than the angle D possessed by the club being duplicated.

One method according to the present invention of obtaining a fairly precise duplication is to match each of the following parameters: (1) the natural frequency $f_o$ (± about 0.1%); (2) the height of the peak at the natural frequency $f_o$ (± about 1.0 inch); (3) the width of the peak Q at 70% of the height of the peak measured from the bottom of the curve at the natural frequency (+ about 2.0 CPM); (4) the width of the peak at 10% of the height of the peak measured from the bottom of the curve at the natural frequency (±4.0 about CPM); (5) the flex point (± about 0.5 inch); and (6) the torque (an angle about equal to or less than D of the club to be duplicated.) This method will result in matching the curves at about the natural frequency of the two clubs within the tolerances recited hereinabove.

Figure 1B:
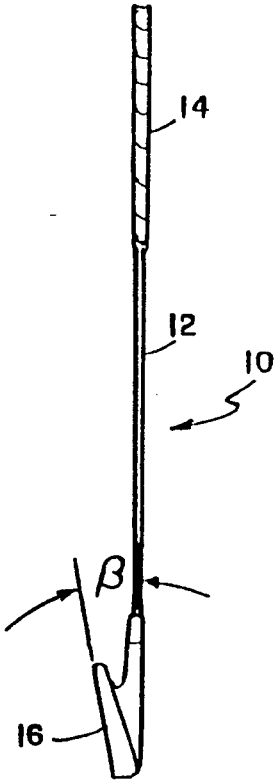

Once the curves and any other desired parameters are matched and the appropriate new shafts thereby determined, the shaft is cut to an appropriate length. The length for the duplication of a golf club is substantially the same as the length of the initial golf club. A club head substantially the same as the club head of the golf club being duplicated is then attached thereto. A club head which is substantially the same should be of the same weight ± about 2.0 grams, more preferably ± about 1.0 grams, and also have the same lie ± about 0.5°, more preferably ± about 0.2°. It is not necessary, however, that the club head be made of the same materials as the head of the club being duplicated. The lie of the club head is the angle $\alpha$ shown in FIG. 1(*a*). The loft is the angle $\beta$ shown in FIG. 1(*b*). The loft is more conventionally represented by the club number, e.g. 5 iron, 3 wood. Thus, two 7 irons will generally have substantially the same loft. The variations of loft and lie angles between successive clubs in a set are well known.

To complete the duplication of the club, the new club shaft should preferably have substantially the same grip diameter as the club being duplicated. The grip diameter should generally not vary from the original by more than about ±1/32 inch, more preferably by not more than about 1/64 inch. In addition, the new club should have a swing weight (described below) within about ±1, more preferable about ±½, swing weights of the club being duplicated. The overall weight of the two clubs should be within about ±9 grams, more preferably ± about 4 grams, most preferably ± about 2 grams.

Figure 6:
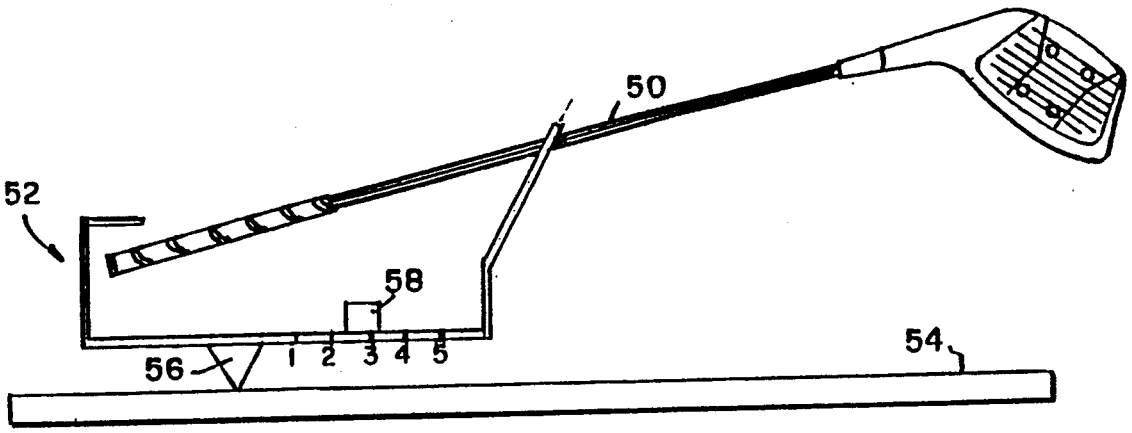
FIG. 6 is a plan view showing a counterbalance used to measure the swing weight of the golf club.

FIG. 6 shows one method for the measurement of the swing weight of a club. A club 50 is placed on a counterbalanced scale 52 on a flat surface 54 and is balanced on the fulcrum 56 using a sliding counterweight 58. A swing weight is a scale factor defined when an increment of weight is added to the club head such that the counterbalance is moved one scale increment. The scale that is used is arbitrary. It is important, however, that the same scale be used in measuring the swing weight for the club being duplicated and the new matching club.

Figure 7:
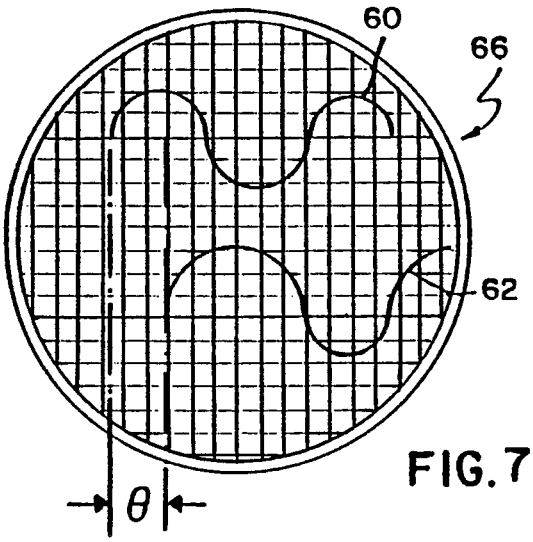
FIG. 7 is a plan view of an oscilloscope showing the measurement of the phase angle.

While not necessary to duplicate a club, a parameter defined herein as the "phase angle" may be duplicated to obtain very precise duplication. As described previously, the motor used to oscillate the club during the duplication process is an AC driven motor. An AC voltage used to drive the motor produces a sine wave when displayed on an oscilloscope- Such a sine wave has a magnitude and a phase angle. The optical sensor array, which may be used to measure the club head excursion, produces a voltage which exhibits a sine wave. As shown in FIG. 7, the sine wave 60 of the motor and the sine wave 62 of the optical sensor may be displayed on a dual trace oscilloscope 66. The phase angle h of the golf club is measured as shown. In order to match phase angles of two different shafts for the purposes of duplicating a club, the phase angles of the two clubs should be within the range of about ±5 degrees, more preferably within about ±2 degrees, of each other.

Once the spectral response curve of a particular club has been determined or a particular club has been duplicated, an entire set of clubs or any subset thereof may be made having analogous characteristics to the particular club. Generally, each number club differs from the next numbered club by about ½ inch in shaft length. For example, a 5 iron is normally about ½ inch shorter than a 4 iron which is normally about ½ inch shorter than a 3 iron, etc. In order to manufacture a set or subset of golf clubs having the same performance characteristics, the spectral response curve for a single club is determined in the manner described above. While the single club (or clubs) to which other clubs in a set is to be matched will preferably be the user's favorite club, other techniques for identifying the appropriate starting club may be utilized. For instance, a player can evaluate on a practice tee a calibrated selection of test clubs to identify the club which he prefers. Or a player's swing can be videotaped and superimposed upon images of other player's swings (for which a preferred club is known) until a match is found and then producing clubs of the same spectral response curve as those of the known player.

Figure 8:
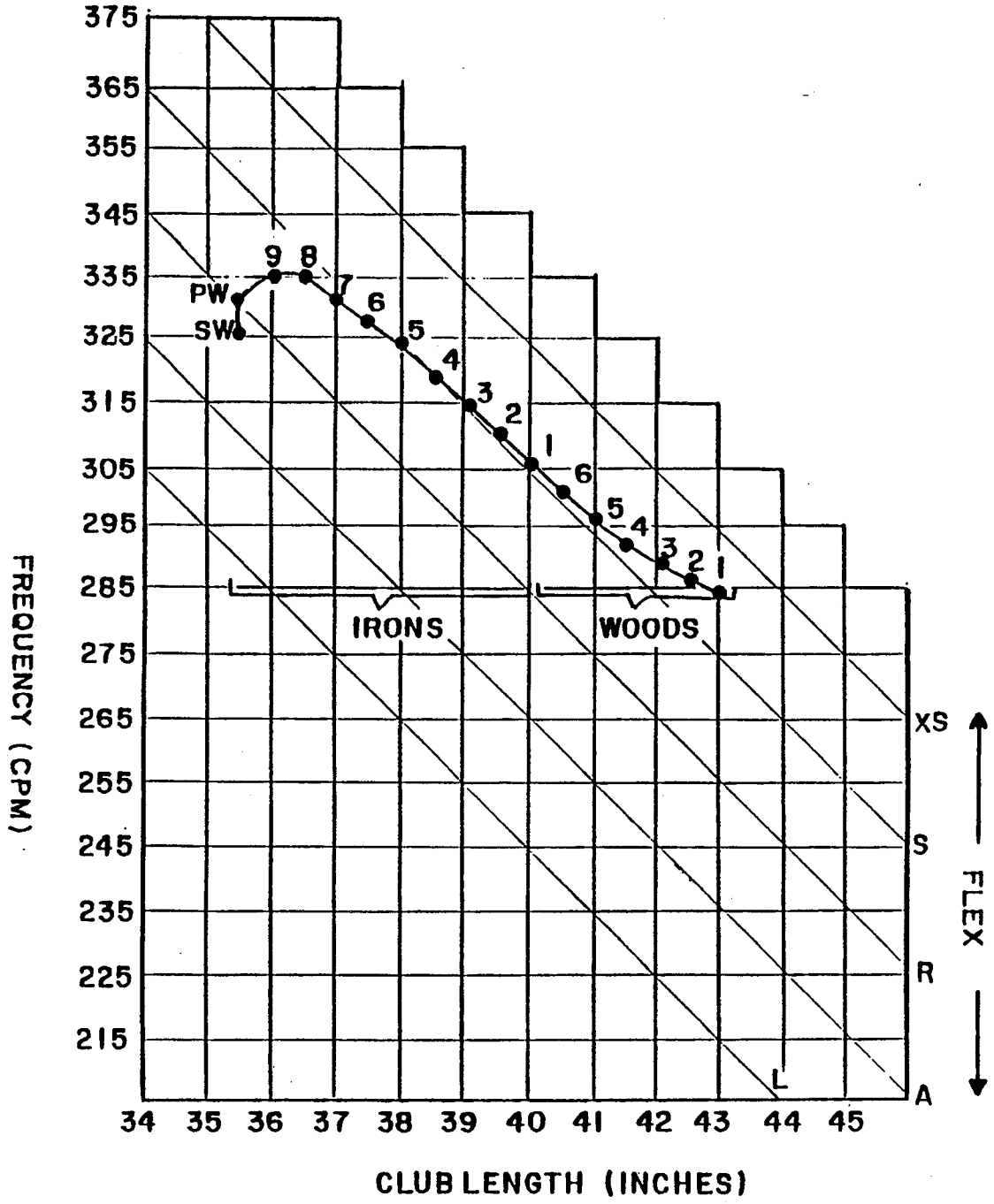
FIG. 8 is a plot of a curve showing the relationship between club length and natural frequency of each club in a set of clubs for a set of golf clubs deemed to be a matched set for a set based upon an inherent frequency gradient of 10 cpm/inch.

Thereafter, the remaining clubs are produced by selecting shafts and appropriate club heads which have substantially the same spectral response curve as the favorite club's curve excepting that the spectral response curve is shifted. In a plot of the relationship of length of club (directly proportional to the club number with the driver or 1 wood being the longest and the wedges the shortest) versus the natural frequency (in cpm) the shift in the spectral response curve when going from one club to the next higher or lower club produces a backward "S" curve such as the one shown in FIG. 8. As shown, the curve becomes convex between about the eight iron and sand wedge (SW) and concave between about the four wood and the driver. The curve between the 8 iron and the 4 wood is less severe, but is not a constant slope. FIG. 8 shows a backward "S" curve for shafts having an inherent gradient (slope) of 10 cpm/inch. Each golf shaft model has a specific inherent gradient which usually ranges from about 8 to about 15 cpm/inch. As a result of this variation, the specific shape of the backwards "S" curve and the increments between successive clubs in a set produced in accordance with the present invention will vary, depending upon the shaft model selected. The shaft model to be selected will depend upon obtaining the best match of spectral response curves.

Table 1 provides appropriate approximate frequency increments between successive clubs for inherent shaft gradients of 8, 10, 12 and 14 cpm/inch. The frequency increment for shaft models having a gradient of 10 cpm/inch between the driver and 2 wood is 2.2 cpm, between 2 wood and 3 wood 2.8 cpm, etc.

TABLE I

| Club | Length of Standard Club | Frequency Increments Between Successive Clubs at Various Gradients (CPM) 8 | 10 | 12 | 14 |
|---|---|---|---|---|---|
| Driver | 43" | >1.0 | >2.0 | >3.0 | >4.0 |

TABLE I-continued

| Club | Length of Standard Club | Frequency Increments Between Successive Clubs at Various Gradients (CPM) 8 | 10 | 12 | 14 |
|---|---|---|---|---|---|
| 2 Wood | 42½ | | | | |
| | | >2.0 | >2.5 | >3.7 | >4.5 |
| 3 Wood | 42 | | | | |
| | | >2.3 | >3.5 | >4.3 | >5.6 |
| 4 Wood | 41½ | | | | |
| | | >3.0 | >4.0 | >5.2 | >6.0 |
| 5 Wood | 41 | | | | |
| | | >3.4 | >4.3 | >5.4 | >6.4 |
| 6 Wood | 40½ | | | | |
| | | >3.5 | >4.4 | >5.5 | >6.5 |
| 1 iron | 40 | | | | |
| | | >3.6 | >4.7 | >5.6 | >6.6 |
| 2 iron | 39½ | | | | |
| | | >3.8 | >4.8 | >5.7 | >6.7 |
| 3 iron | 39 | | | | |
| | | >3.9 | >4.9 | >5.9 | >6.8 |
| 4 iron | 38½ | | | | |
| | | >3.8 | >5.0 | >5.7 | >7.0 |
| 5 iron | 38 | | | | |
| | | >3.6 | >4.5 | >5.4 | >6.5 |
| 6 iron | 37½ | | | | |
| | | >3.3 | >3.5 | >5.2 | >6.3 |
| 7 iron | 37 | | | | |
| | | >3.1 | >2.0 | >4.5 | >6.0 |
| 8 iron | 36½ | | | | |
| | | >1.0 | >0 | >2.0 | >4.0 |
| 9 iron | 36 | | | | |
| | | >−5.0 | >−4.8 | >−4.0 | >−2.0 |
| PW | 35½ | | | | |
| | | >−5.0 | >−4.5 | >−4.0 | >−3.5 |
| SW | 35½ | | | | |

The increments shown in Table 1 are appropriate for duplicating shafts with nominal inherent gradients (slopes) of 8, 10, 12, and 14 cpm/inch. Other shafts, for example those with a 13 cpm/inch, require extrapolation of the increments shown in Table 1. As the inherent cpm/inch value for shaft model shifts, the increments must be adjusted accordingly. In all cases a plot of the relationship of length of club versus the natural frequency of a set of clubs produces the backward "S" curve relationship. In this manner an entire set of clubs can be manufactured with each club having the same performance characteristics as a single specific club.

Figure 10:
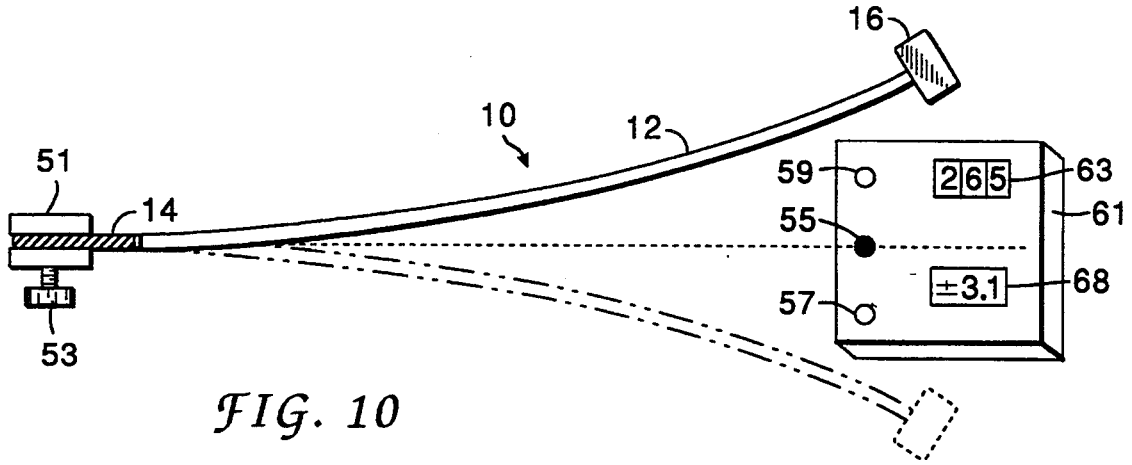
FIG. 10 is a top view showing the operation of the oscillating and sensing means of the portion of the invention applicable to the golf club only.

An alternative and the presently preferred method for measuring both selectivity Q and natural frequency $f_o$ is best described with reference to FIG. 10. As shown, a club 12 is clamped in a stationary vise 51 mounted on a support surface (not shown), tightened in place by a screw or lever 53 and excited into oscillation by preferably manually pulling the club to one side a few inches and then releasing it so that it vibrates in a plane that causes the shaft to pass repeatedly over a box 61 that contains the electronics comprising the circuitry shown in FIG. 11. The term "golf club" is defined herein and includes complete golf clubs as well as shafts to which a dead weight is attached as well as clubs or shafts which do not have actual grips thereon. The degree of tightening of a club within the vise should be as uniform from club to club so that the results of the determinations are properly comparable.

As shown, a source of infrared (IR) power 64 drives an IR emitter 55 which emits IR energy, preferably not in the human visible spectrum. The IR energy reflects off the club shaft 12 and the reflection is received by the appropriate IR detector 59 or 57 as the club passes alternatively back and forth above them. Stable high frequency, e. g. 4 megahertz, clock pulses from a crystal oscillator 73 are gated into both timer/gates 65 and 67 started and stopped by low frequency, e.g. 3 to 7, pulses per second from detectors 59 and 57, respectively.

Figure 12:
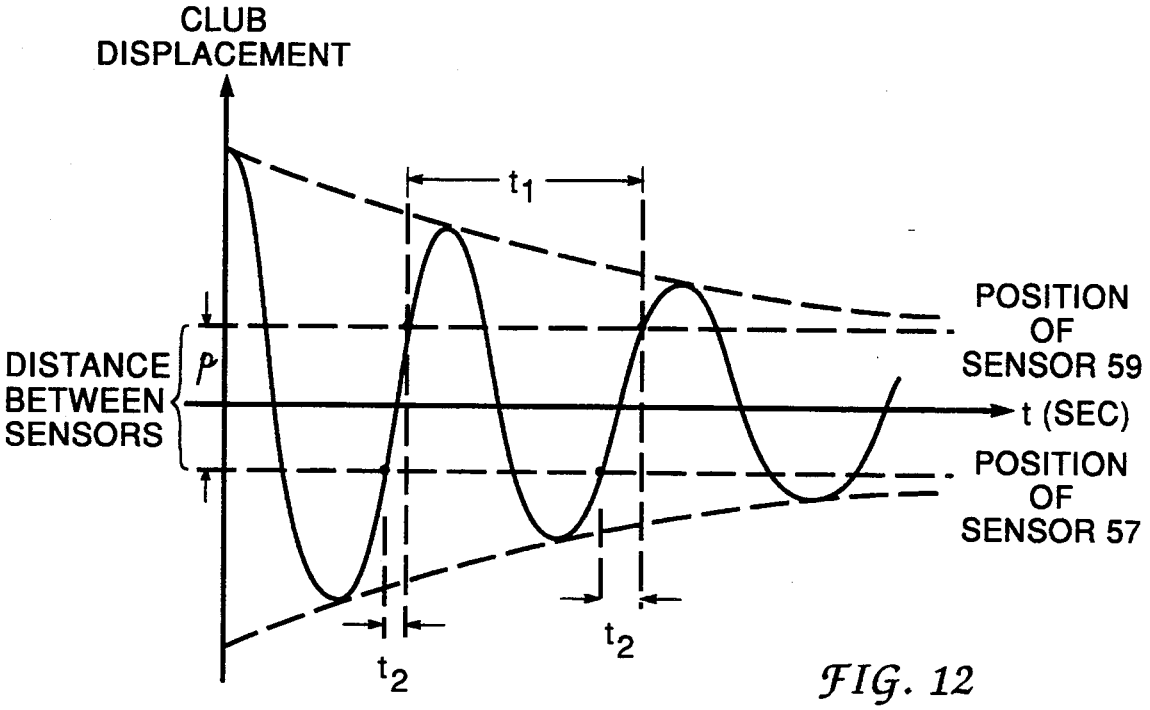
FIG. 12 is a plot of physical displacement versus time of the golf club oscillating in FIG. 10 and the related sensor locations.

FIG. 12 is a plot of a club head displacement versus time. $t_1$ is the time for one complete cycle of the club head, i.e. the time between two successive appearances of the club head above a single sensor. $t_2$ is the time for the club head to pass from above one sensor to above the second sensor. p is the distance between the sensors. The dotted lines are the decay envelope for the velocity as the club head slows.

The club frequency, $f_o$, is computed in microprocessor 69 by inverting the count of timer/gate 65 and multiplying by the clock rate of the crystal oscillator and times 60 to convert from seconds to minutes so that the output is provided in cycles per minute (CPM). The value is held until reset by the display driver/memory 71. To increase accuracy, the results of several successive determinations are accumulated and averaged.

Velocity of the golf club during each excursion is calculated by starting timer/gate 67 with a pulse from sensor 59 and stopping the timer/gate 67 with a pulse from sensor 57. Pulses from the crystal oscillator 73 are accumulated during the interval so defined and shown in FIG. 12 as $t_2$ and transmitted to the microprocessor after each club oscillation. By comparing cycle to cycle velocity calculations, the rate of decay of the velocity contained in the exponent of the standard velocity equation:

$$V=e^{-\alpha t}\sin(2\pi f_o t)$$

provides a value of Q after only about 10 to 20 cycles which occurs in about 4 seconds. In this equation, $\alpha$ is the damping factor and t is the elapsed time. Further details about the conventional mathematics utilized herein may be found in such as *Introductory Circuit Theory,* E. A. Gilliman, John Wiley, NY (1953). Q is then equal to $2\alpha$.

Figure 11:
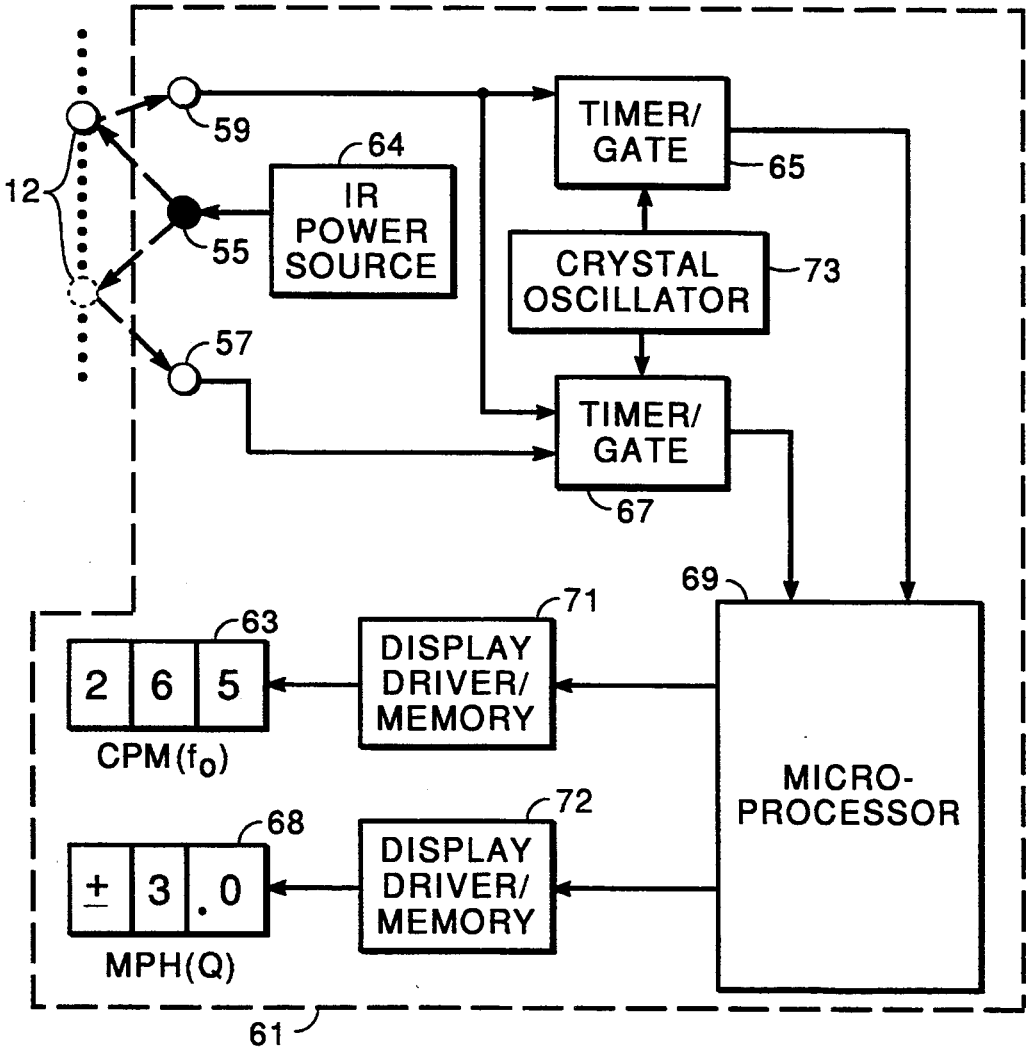
FIG. 11 is a functional block diagram of the electronic sensors for frequency $f_o$ and selectivity Q as disclosed in this invention.

After the computation is made in the microprocessor 69, the result is shown on display 68 driven by display driver/memory 72 and retained until reset. This method of measuring Q is much faster than the method discussed in the embodiment of FIGS. 1–4. The equipment used in the circuitry of FIG. 11 is commercially available.

The rate of decay of the velocity of oscillation is determined by mathematical means described herein to be related to the damping factor which is proportional to the selectivity by well known second order differential equations that describes damped harmonic motion. Alternatively, the rate of decay of club head or shaft displacement can be measured and the same selectivity, damping factor, or bandwidth calculation made. Another alternative is to measure acceleration of the clubhead or shaft of an oscillating club and derive the same parameters.

One application of the selectivity measurement Q is made by marking it on clubs (or shafts) so that a golfer can rate the relative risk factor associated with an off-speed swing of each club so designated even without the golfer having had determined variations in his swing speeds. The higher the value of Q, the more intolerant a club is to off-speed swings and the greater the risk of a bad shot.

Figure 14:
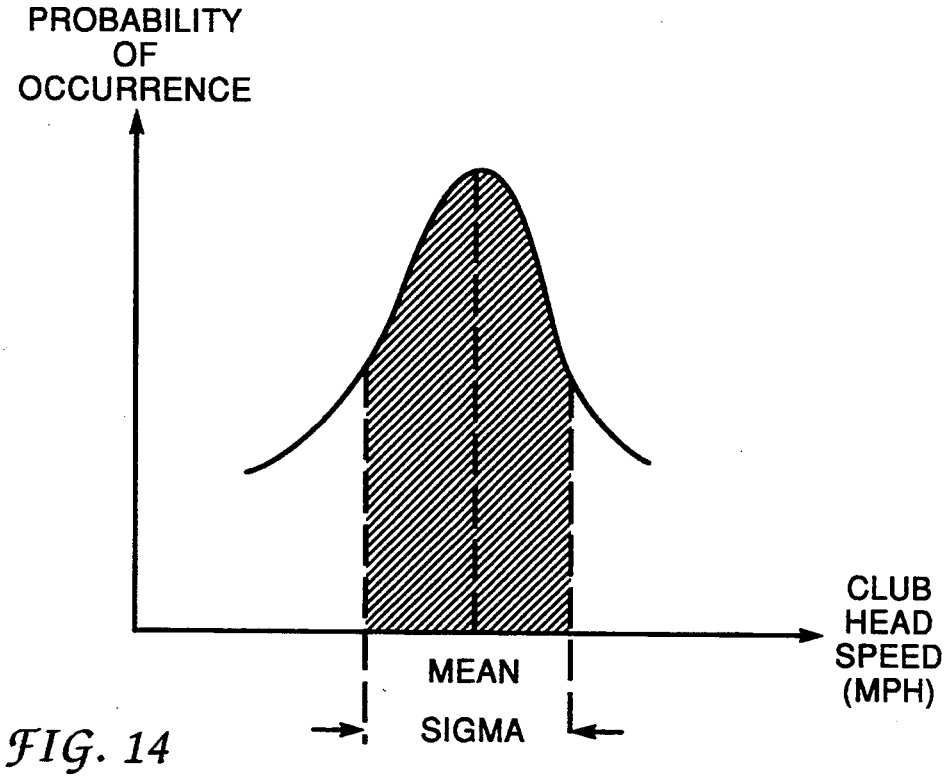
FIG. 14 is a plot of variation in club head speed vs. probability of occurrence.
Figure 13:
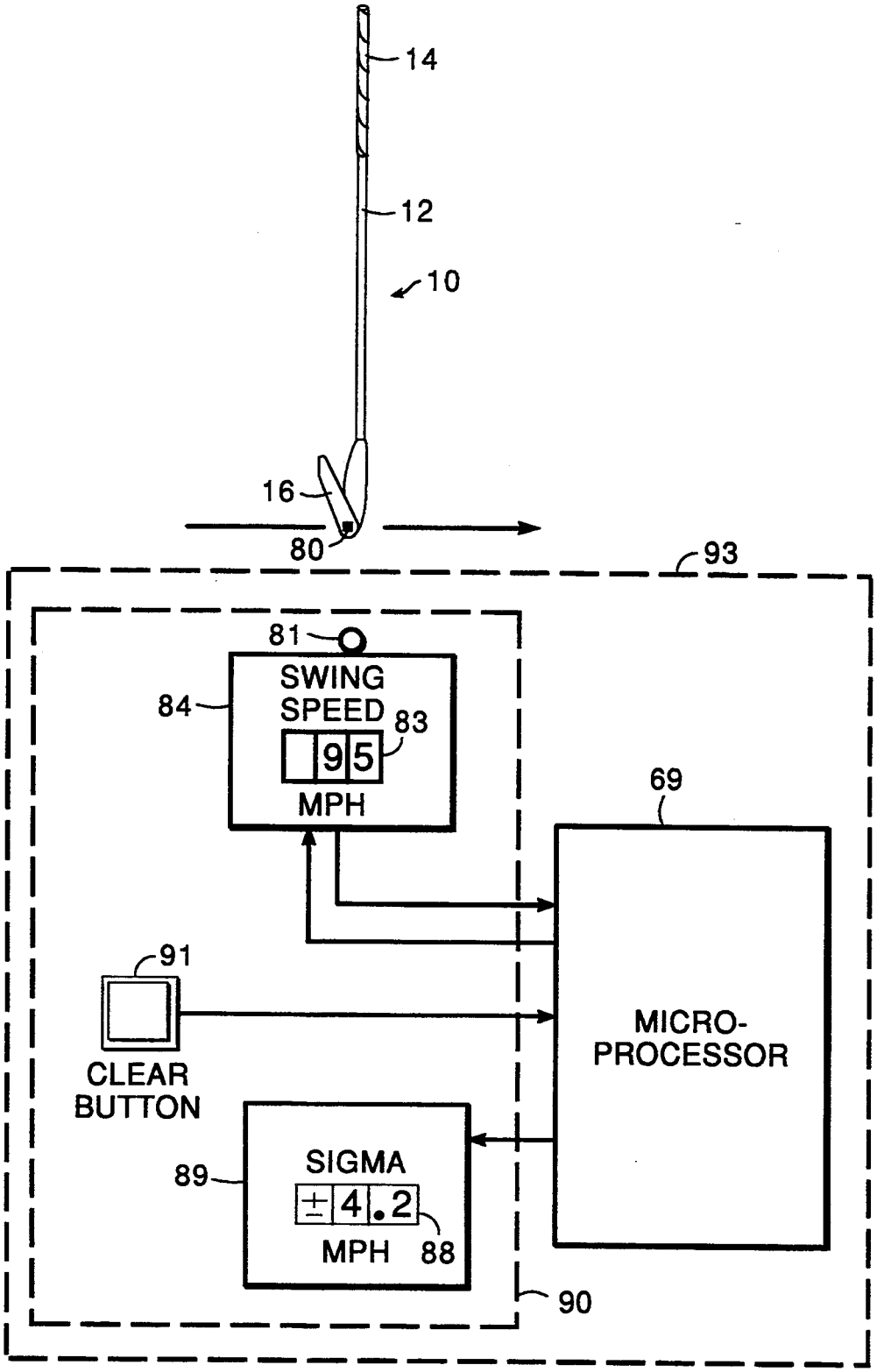
FIG. 13 is a functional block diagram of the swing speed sensor and statistical calculator and display disclosed in this invention.

To make the best use of club selectivity as obtained above by either method, the preferred embodiment is to derive swing statistics from a players's swings of the club having the best shaft flex for him. In this method, a player swings each of several calibrated test clubs many times until the sigma, i.e. the standard deviation of a normal distribution which contains the results of ⅔ of all swings recorded with that club, as shown in FIG. 14, and which is displayed on display 88 in Fig. 13, no longer increases. The preferred method of measuring a golfer's swing speed and variations therein is performed by having a golfer swing a club 10 repeatedly in close proximity to a commercially available club speed measuring device 84. Preferably, a magnetic sensor 81 is used to sense club head motion, sometimes with the aid of a piece of metal tape 80 added to the club head 16, and the speeds of the swings taken since the device has been cleared by manually depressing CLEAR button 91 whenever a different test club is selected are used to form a best-fit normal distribution curve. Mean swing speed for that test club and sigma are displayed on display 83 and 88 respectively.

The club registering the largest $f_o$ and the smallest sigma is the optimum for him and that club is the one which should be used to assign a value of sigma and $f_o$ to that player.

It is currently believed that conservative golfers should utilize a golf club having a selectivity Q essentially equal to their sigma, when both are measured in the same units, e.g. miles per hour. Risk takers, on the other hand, could use golf clubs having a much higher Q rating, especially if driving distance is more important than accuracy because a higher Q will produce greater distance while sacrificing accuracy.

Selectivity Q of existing clubs can be altered by modification of the hardness of the grip by changing grips or by using underlistings of different hardnesses. Softer grips lower the selectivity Q and harder grips raise it. Grips designed specifically to raise or lower selectivity Q are part of this invention.

Another way to raise of lower selectivity while keeping the frequency $f_o$ constant involves the selection of shafts known to exhibit a value of Q as required in a specific application. Since the value of Q is found to vary more by shaft model than within editions of the same model, target selectivities are achieved by choosing the shaft model shown by experimentation to offer the range of Q needed in an analogous way that shaft frequency targets are achieved.

Shafts can be designed with target values of selectivity Q in mind. Also, some shaft designs that exhibit values of Q combined with other factors could be eliminated as undesirable. Conversely, very high Q shafts could be desirable for golfer's with consistent swing speeds desiring to trade accuracy for added distance.

The following Example illustrate the duplication of a single golf club and preparing other clubs therefrom. It is illustrative of the invention and should not be considered as limiting the invention.

EXAMPLE

Figure 9:
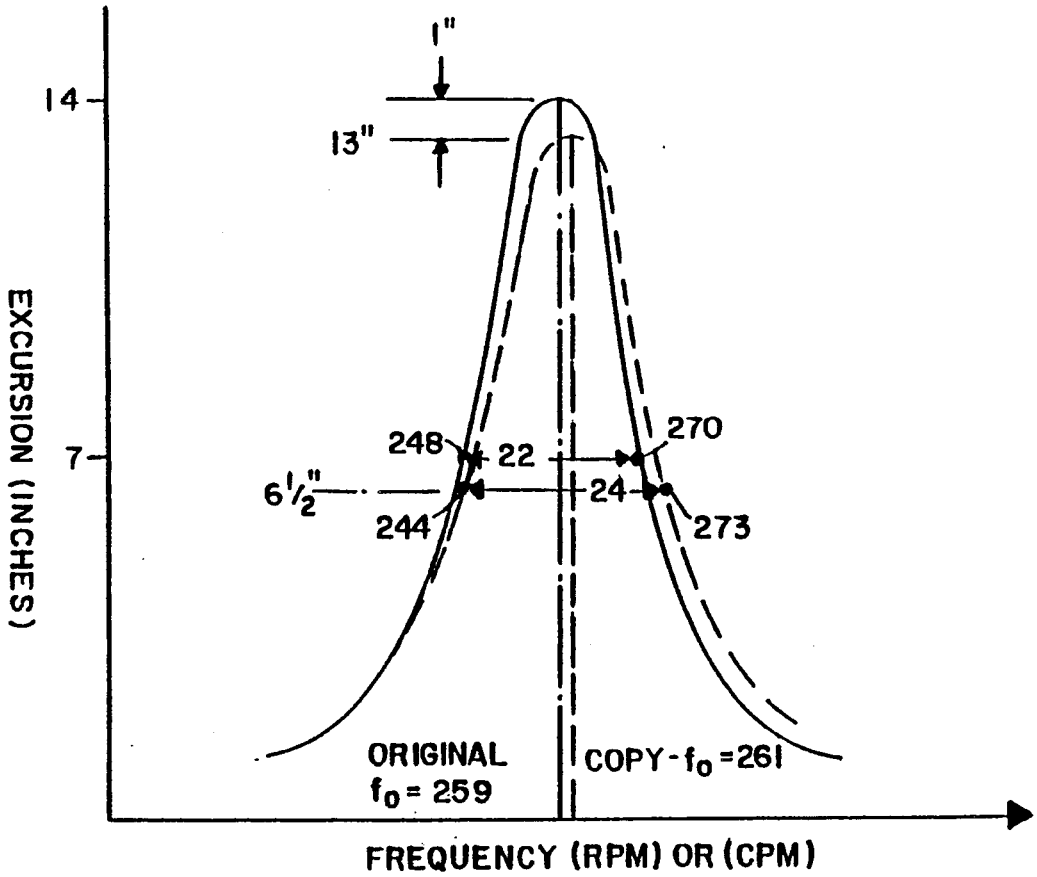
FIG. 9 is a plot of the spectral response curve for two matched golf clubs from the Example.

A driver (1 wood) was oscillated using an oscillating means as shown in FIG. 2 except a ruler was used instead of an optical sensor array to measure the excursion of the club head. The frequency and excursion measurements were taken over a range of frequencies of from 200 to 800 cycles per minute (CPM). The frequency and excursion measurements were then plotted to form a spectral response curve unique to the club. The curve is shown in FIG. 9 as a solid line. From a stock of other shafts with predetermined spectral response curves a shaft having substantially the same spectral response curve was selected and a dummy head having approximately the same weight as the head of the club being duplicated was attached. Its curve is shown as the dotted line in FIG. 9. As can be seen from FIG. 9, the frequencies of the two curves were within about ±2 CPM at all points, the height of the peak at the natural frequency of the club being copied was 1.0 inch higher than the height of the $f_o$ peak of the new club. The width of the peak at 50% of the height of the peak for the master club was 22 CPM and the width of the peak at 50% of the height of the peak for the new club was 24 CPM, giving a difference of 2 CPM. At 70% of the maximum heights, i.e. Q, the difference is even less. The new club was then provided with a club head of the same loft and lie as the master club and a grip diameter substantially the same as that of the master club. The club head and grip were selected to appear the same as on the master club. When used on a driving range, a player could not distinguish between them.

A 5-iron is prepared to match the characteristics of the above driver (which had been prepared from a shaft having an inherent gradient of 10 cpm/inch). In accordance with Table I and FIG. 8, 5-iron is produced having (i) a length 5 inches shorter than the driver, (ii) a natural frequency of 300 cpm, i.e. 40.1 cpm greater than that of the driver, and (iii) a spectral response curve having a maximum height of 13.4 inches and a width Q of 23 cpm. The 5-iron is produced by selecting a commercially available shaft of the same shaft model and having the desired spectral response curve, cutting that shaft to the appropriate length, and attaching a 5-iron head and grip. When used on a driving range by the player for whom the driver was prepared, the 5-iron feels substantially the same.

What is claimed is:

1. A method of determining the selectivity Q of a golf club for use by a golfer to determine the relative risk factor associated with a particular club comprising:

(1) subjecting a golf club having a grip end and a club head attached to a stationary means at its grip end to an energy pulse to cause the club head end to oscillate;

(2) positioning two detectors below and equidistant from a line extending from the club grip end to the club head end before the club is oscillated for measuring the time it takes to complete an oscillation cycle;

(3) determining the velocity V of the oscillating club according to the formula:

$$V=p/t_2$$

wherein p is the distance between the two detectors and $t_2$ is the time in seconds during which it takes a given point of a club to travel from one detector to the other;

(4) thereafter calculating the rate of decay of club velocity by comparing successive velocity determinations using that rate in the velocity equation:

$$V=e^{-\alpha t}\sin(2\pi f_o t)$$

wherein $\alpha$ is the damping factor and t is the elapsed time;

(5) thereafter solving for Q in the formula $Q=2\pi$.

2. A method for selecting the best clubs for a golfer among a plurality of clubs comprising the steps of:

(1) oscillating a first golf club over various frequencies and determining a natural frequency $f_o$ for said club, each frequency in an oscillation relating to a distinct excursion;

(2) determining the selectivity Q for the first golf club, Q being a range of frequencies wherein each frequency in the range has an excursion equal to or greater than about 70% the excursion corresponding to the natural frequency $f_o$;

(3) swinging each of a first set of golf clubs and measuring for each swing the speed of the swing;

(4) measuring the highest mean speed and determining the sigma for each club in step (3);

(5) terminating the swinging of the set of clubs in step (3) and terminating the measuring of the highest mean speed in (4) when the value of sigma is substantially constant;

(6) selecting a second set of gold clubs from the first set of golf clubs with the highest mean speed and smallest sigma, and determining a natural frequency $f_o$ for each club in the second set; and (7) selecting a club from the second set of clubs with a natural frequency $f_o$ substantially similar to the natural frequency $f_o$ of the first blue as determined in step (1) and a Q value that correlates to the sigma value determined in step (5).

3. The method of claim 2 wherein each of the first set of clubs has substantially the same Q values.

4. The method of claim 2, wherein termination of swinging takes place when sigma stabilizes at about 0.1 mph.

5. The method of claim 2, wherein the correlation between Q and sigma in step (7) is such that the Q value of the club selected is slightly higher than the sigma value wherein both values are computed in the same units.

6. The method of claim 3, wherein the correlation between Q and sigma in step (7) is such that the Q value of the club selected is significantly higher that the sigma value wherein both values are computed in the same units.

7. The method of claim 2, wherein the correlation between Q and sigma in step (7), is such that the Q value of the club selected is significantly higher than the sigma value wherein both values are computed in the same units.

8. A method of choosing a golf club comprising evaluating the selectivity Q of the club wherein the value of Q is determined by:

(1) oscillating a first golf club over various frequencies and determining a natural frequency $f_o$ for the club, each frequency in an oscillation relating to a distinct excursion;

(2) determining the selectivity Q for the first blue, Q being a range of frequencies wherein each frequency in the range has an excursion equal to or greater than about 70% of the excursion corresponding to the natural frequency $f_o$.

(3) repeating steps 1 and 2 for at least one additional golf club, and (4) choosing a golf club having a specific selectivity Q.

* * * * *

UNITED STATES PATENT AND TRADEMARK OFFICE

CERTIFICATE OF CORRECTION

PATENT NO. : 5,351,951

DATED : Oct. 4, 1994

INVENTOR(S) : George W. Hodgetts

It is certified that error appears in the above—identified patent and that said Letters Patent is hereby corrected as shown below:

Column 12, line 64:
delete "$Q=2\pi$" and insert -- $Q=2\alpha$--.

Column 13, line 16:
delete "gold" and insert --golf--.

Column 13, line 22:
delete "blue" and insert --club--.

Column 13, line 26:
delete "values" and insert --value--.

UNITED STATES PATENT AND TRADEMARK OFFICE

CERTIFICATE OF CORRECTION

PATENT NO. : 5,351,951

DATED : October 4, 1994

INVENTOR(S) : George W. Hodgetts

It is certified that error appears in the above-indentified patent and that said Letters Patent is hereby corrected as shown below:

Column 14, line:
delete "blue" and insert --club--.

Signed and Sealed this

Thirteenth Day of December, 1994

*Attest:*

*Attesting Officer*

BRUCE LEHMAN

*Commissioner of Patents and Trademarks*